United States Patent [19]

Cunard

[11] Patent Number: 4,961,558

[45] Date of Patent: Oct. 9, 1990

[54] PLAY GYM HINGE GUARD

[75] Inventor: Joel C. Cunard, Bedford, Pa.

[73] Assignee: Hedstrom Corp., Bedford, Pa.

[21] Appl. No.: 304,500

[22] Filed: Jan. 31, 1989

[51] Int. Cl.[5] ..... A47B 96/06

[52] U.S. Cl. ..... 248/370; 248/230

[58] Field of Search ..... 248/370, 230, 345; 272/85, 86; 16/250, 252, 253, 282; 403/23; 185/40 C

[56] References Cited

U.S. PATENT DOCUMENTS

| | | | |
|---|---|---|---|
| 2,609,031 | 9/1952 | Puscas | 272/86 |
| 3,596,906 | 8/1971 | Parmer | 403/23 X |
| 3,682,504 | 8/1972 | Brimberg | 403/23 |
| 3,754,786 | 8/1973 | Bouchert | 16/250 X |
| 3,972,563 | 8/1976 | Gustafson | 16/250 X |
| 4,018,538 | 4/1977 | Smyrni | 272/85 X |
| 4,408,924 | 10/1983 | Huebner | 403/23 |
| 4,822,033 | 4/1989 | Kohus | 272/86 |
| 4,856,141 | 8/1989 | Sassenberg | 16/250 |

FOREIGN PATENT DOCUMENTS

| | | | |
|---|---|---|---|
| 2051185 | 4/1972 | Fed. Rep. of Germany | 16/250 |

*Primary Examiner*—J. Franklin Foss

*Attorney, Agent, or Firm*—Nutter, McClennen & Fish

[57] ABSTRACT

A protective cover for the supporting bracket of a slide ride swing includes a pair of similar relatively rigid plates reaeasably mounted to opposite sides of the bracket so as to prevent pinch points at the bracket from being reached by a child's fingers, while allowing full swinging motion of the hangers of the glide ride.

8 Claims, 1 Drawing Sheet

PLAY GYM HINGE GUARD

This invention relates to children's play gym apparatus. It relates more particularly to a device in the nature of a protective cover or guard for shielding children's fingers from potential pinch points on the play gym.

BACKGROUND OF THE INVENTION

A typical children's gym set usually includes several pieces of play equipment suspended from a horizontal crossbar supported above the ground. These items of play equipment include swings, rings, slides and often a so-called glide ride or swing-for-two. This glide comprises a pair of parallel tubes which hang down from the crossbar. The upper ends of the tubes are pivotally connected to a bracket mounted to the crossbar, the lower ends of the tubes being pivotally connected to a short link. Pivotally mounted near the lower ends of the tubes is an elongated horizontal seat member able to support riders at opposite ends. This parallel arrangement of tubes and the pivotally connected seat member form a pantograph so that when the tubes swing back and forth about their connections to crossbar, the seat member remains more or less parallel to the ground. Thus two children sitting at the opposite ends of the seat member can swing back and forth with little danger of their sliding off that member.

It has been found, however, that in practice, children often tend to stand on the seat member or other elements of the swing frame while the ride is in motion. This practice places their hands and fingers within reach of the pivotal connections between the upper ends of the seat-supporting tubes and the bracket mounted to the gym set's crossbar. Due to the nature of these pivotal connections, pinch points are created there which have in the past caused injury to some children.

It has been proposed to avoid this problem by redesigning the bracket which connects the glide to the crossbar to eliminate the pinch points. However, such proposals have not been implemented thus far because they have been found to be too expensive. It has also been suggested to encage the glide-supporting brackets so as to isolate them from the children's straying fingers. However, these suggestions have not resulted in any practical solution to the problem either. Some of these protective cages have tended to be so large and obtrusive that they spoil the overall appearance of the play gym. Some others have proved to be too costly and some failed to perform their protective function in that in accommodating the swinging motion of the glide ride, they have left avenues of approach to the pinch points.

SUMMARY OF THE INVENTION

Accordingly, the present invention aims to provide a protective cover or guard for the glide ride bracket of a children's play gym.

Another object of the invention is to provide such a protective cover which permits swinging motion of the glide ride without giving finger-access to the pinch points at the glide bracket.

A further object of the invention is to provide a protective cover or guard of this type which is compact and does not spoil, but rather enhances, the overall appearance of the gym set.

Still another object of the invention is to provide a protective cover or guard for a glide ride bracket which is very inexpensive to manufacture.

A further object of the invention is to provide such a protective cover which can be installed on the gym set easily at the factory or at home by the customer when assembling the gym set.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the protective cover of this invention comprises a pair of identical, generally flat plates made of plastic or other suitable weather-resistant material. Each plate has a narrow lip or skirt extending around its periphery and an opening or cutout at or adjacent to the edge of the plate to provide clearance for the gym set's crossbar when the cover is installed.

To install the cover, the two plates are positioned opposite one another on opposite sides of the glide ride bracket and the pair of tubes depending therefrom, with their peripheral flanges facing one another and with the gym set crossbar being received in the openings in the two plates. Fasteners, laces or other suitable means are then used to releasably secure the two plates to the opposite sides of the bracket.

The two plates extend beyond the sides of the bracket and below the bracket to a distance that makes it very difficult, if not impossible, for a child to insert his or her hand or fingers into the very narrow space between the two plates so as to reach the pivotal connections at the bracket. Yet the glide ride tubes connected to the brackets are free to swing back and forth between the two plates. The flanges at the edges of the plates provide bearing surfaces for those swinging tubes at the lower portion of the cover. The flanges also help to stiffen or rigidify the plates thereby making it difficult for a child to spread them apart to gain access to the glide bracket.

Preferably also, each plate is formed with a relatively wide arcuate bulge or deformation that creates a pronounced arcuate ridge on the outside surface of the plate and an equally pronounced arcuate cavity or groove on the inside surface of each plate which, when the plates are installed, faces the comparable arcuate groove in the other plate comprising the cover. These bulges or grooves help to stiffen the plates; they also provide clearance for the bracket pivot pins.

The two plates comprising this protective cover, being identical and made of plastic, can be fabricated quite inexpensively using any conventional molding process. The plates can also be installed quite easily using standard hand tools or, when installed at home, without any tools at all. When installed, the cover provides effective protection against finger injuries at the pinch points present at many conventional glide ride support brackets. Yet the protective cover, being small and compact, does not detract from the overall appearance of the play gym.

BRIEF DESCRIPTION OF THE DRAWING

For a fuller understanding of the nature and objects of the invention, reference should be had to the following detailed description taken in connection with the accompanying drawing, in which.

DESCRIPTION OF THE PREFERRED EMBODIMENTS

Figure 1:
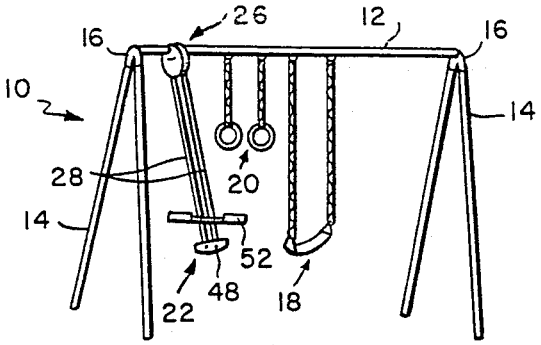
FIG. 1 is an isometric view of a children's gym set incorporating a glide ride bracket cover made in accordance with this invention.

Refer first to FIG. 1 of the drawing which shows a more or less conventional play gym 10 comprising a horizontal support member or crossbar 12 which is supported above the ground by four legs 14 connected to opposite ends of crossbar 12 by suitable end brackets 16. Suspended from crossbar 12 are the usual pieces of play equipment commonly found on such gym sets. For illustrative purposes, we have shown a swing 18, a pair of rings 22 and a glide ride 24. Glide ride 24 is conventional except for the protective cover or guard shown generally at 26 at the upper end of the glide ride.

Figure 3:
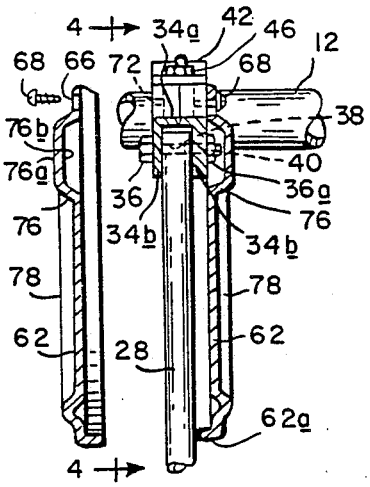
FIG. 3 is a fragmentary sectional view taken along line 3—3 of FIG. 2.
Figure 4:
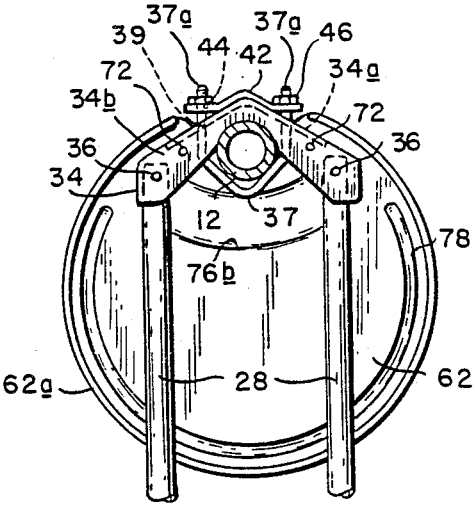
FIG. 4 is a fragmentary sectional view taken along line 4—4 of FIG. 3.

Referring to FIGS. 1, 3 and 4, a typical glide ride comprises a pair of closely spaced parallel generally vertical tubular hangers 28 whose upper ends are pivotally connected to a generally arcuate bracket 34 which bridges crossbar 12. Bracket 34 is a shell-like member stamped of metal having a top wall **34*a* and a pair of depending side walls 34*b*. The upper ends of hangers 28 are inserted between the two bracket side walls at the opposite ends of the bracket and are pivotally connected to those side walls by fasteners 36 such as pins or bolts extending through registering holes 38 and 40 in the hangers and bracket side walls respectively. If the fasteners are bolts, nuts 36*a* are turned down on the threaded ends of the fasteners as shown in FIG. 3. Thus the hangers 28 are able to swing back and forth on their pivots 36 relative to the bracket 34**.

Bracket 34 bridges crossbar 12 and is clamped thereto by a V-bolt 37 which engages under the bar and whose two threaded ends **37*a* pass up through holes 39 in the bracket top wall 34*a* disposed on opposite sides of the crossbar. A saddle bracket 42 is engaged over the crossbar above bolt 37, with the bolt ends being received in holes 44 in that bracket. The two brackets 34 and 42 are drawn together by nuts 46 turned down on bolt ends 36*a***.

As shown in FIG. 1, lower ends of hangers 28 are pivotablly connected to an inverted U-shaped beam 48 so as to maintain the hangers 28 in parallel. The ends of beam 48 extend beyond the hangers and function as foot rests for the riders of ride 22. Also, pivotally connected to hangers 28 appreciably above beam 48 is a seat member 52 whose ends extend well beyond tubes 28 and function as seating platforms for those riders. The illustrated arrangement of parallel pivoted hangers and seat member form a pantograph so that seat member 52 remains parallel to the ground as hangers 28 swing back and forth on bracket 34.

As best seen in FIGS. 3 and 4, the pivotal connections between the hangers and bracket are such as to produce spaces between the hanger ends and the bracket structure at the opposite ends of the bracket. The sizes of these spaces vary depending upon the swing angle of the hangers 28. Therefore, if a child should happen to insert a finger into one of these spaces while swinging on the glide ride, that finger could be pinched or crushed between a hanger 12 and the bracket wall. The cover or guard 26 is intended to prevent this from happening.

Figure 2:
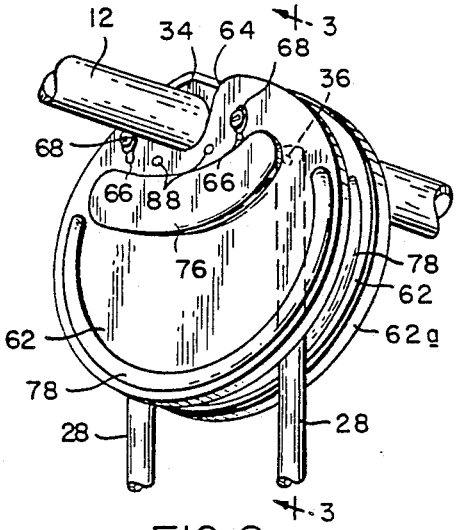
FIG. 2 is a fragmentary isometric view on a much larger scale showing the protective cover in greater detail.

Referring to FIGS. 2 and 3, guard 26 comprises a pair of identical plates 62, preferably molded of a suitable relatively strong, weather-resistant plastic material such as polyethylene. The illustrated plates 62 are generally disk-shaped, although other shapes, e.g. elliptical, are possible which will accomplish the invention objectives described herein. Each plate includes a relatively narrow flange or lip **62*a* which extends around its periphery. The flange 62*a* helps to stiffen the plate. It also provides a bearing surface for the hangers when the glide ride is in motion. Each plate 62 is provided with a cutout or opening 64 at the top thereof to provide clearance for the play gym crossbar 12 when the cover 26** is installed on the play gym.

Each plate 62 also has a pair of holes 66 spaced on opposite sides of cutout 64 for accommodating a pair of threaded fasteners 68 which are screwed into registering holes 72 in the bracket side walls **34*b* in order to secure the plates to the opposite sides of the bracket 34 as shown in FIGS. 2 and 3. Holes 66 are desirably elongated vertically and tilted outward as shown in FIG. 2 to provide tolerance in the event that the positions of the holes 72** in the bracket vary from one gym set to another.

Preferably, as best seen in FIG. 3, each plate 62 is molded or otherwise formed with a pronounced arcuate deformation or feature 76 which creates a raised rib **76*a* on the outside surface of the plate and a depression or groove 76*b* in the plate inside surface. This feature helps to strengthen and stiffen the plate. The depression 76*b* also provides clearances for the bolts 36 and nuts 36*a* connecting the hangers 28 to bracket 34. Also, for added stiffness, an arcuate feature 78 is provided adjacent to the edge of each plate 62 below its rib 76**.

When the plates 62 are secured by fasteners 68 to the opposite sides of bracket 34, the tubular hangers 28 extend down between the two plates and are free to swing back and forth while the plates remain stationary, with the hangers sliding along the edges of the plate flanges **62*a*. Since the bracket 34 is relatively narrow, the gap between the plate flanges 62*a* is also quite narrow. In addition, the diameters of plates 62 are large enough, e.g. 8 to 12 inches, so that the plates 62 extend well beyond the ends of bracket 34 and relatively far down on hangers 28. Resultantly, it is quite difficult for a child to insert his or her hand between the plates to the extent that fingers could become pinched at the pivotal connections between the hangers 28 and the bracket 34. Yet the plates do not impede in any way the swinging motion of the hangers. Nor does the presence of the protective cover 26 detract from the appearance of the play gym 10 as a whole. In fact, it functions to finish off the top of the glide ride 22 where it joins the crossbar 12**.

Figure 5:
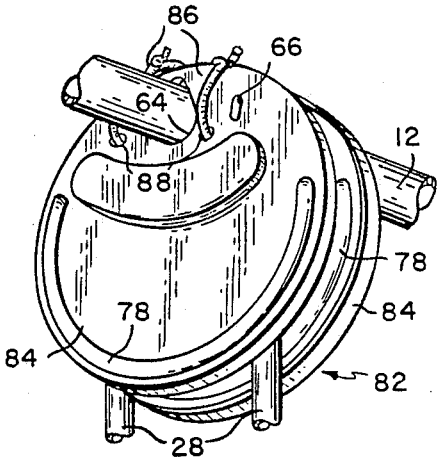
FIG. 5 is a view similar to FIG. 2 showing another bracket cover embodiment.

The cover 26 described above is designed for installation at the factory. FIG. 5 shows a similar cover 82 which is designed for installation by the customer who purchases a play gym 10 in a knockdown state for assembly at home. In fact, the cover 82 can be retrofit to an old already standing play gym.

Cover 82 is more or less the same as cover 26 except that its two plates 84 are secured to bracket 34 by straps or lacings 86 instead of by threaded fasteners. For this, a small hole 88 is provided on each side of the plate cutout 64 and a strap 86 is inserted through the opening 88 of each plate 84 comprising the cover 82, passing underneath the crossbar 12. Then the two ends of each strap 86 are tied or otherwise secured together at the top of the cover 82 above crossbar 12 thereby pulling the plates 84 tightly against the underside of the crossbar. Preferably, each strap 86 is a plastic "lock strip" having an eye at one end through which the serrated other end is pulled. Thus cover 82 as a whole performs the same protective function described above in connection with cover 26. Preferably in this cover embodiment 82, the crossbar receiving openings 64 in the plates 84 are holes as shown rather than notches to provide positive vertical support for the plates. The plates are slid onto the crossbar prior to assembly of the crossbar end brackets 16.

It will be seen from the foregoing that the covers 26 and 82 provide a significant amount of protection against child's fingers becoming pinched or jammed between the swinging hangers and the supporting bracket of a glide ride-type swing. Yet the covers can be made and assembled to the gym set quite easily and do not detract from the appearance of the gym set. Therefore, they should find wide acceptance in the toy field where injuries to children are much to be avoided.

It will thus be seen that the objects set forth above, among those made apparent from the preceding description are efficiently attained. Also, since certain changes may be made in the above constructions without departing from the scope of the invention, it is intended that all matter contained in the above description or shown in the accompanying drawing shall be interpreted as illustrative and not in a limiting sense.

It should also be understood that the following claims are intended to cover all of the generic and specific features of the invention herein described.

I claim:

1. A protective cover for a glide ride swing of the type including a pair of tubular hangers and a bracket for pivotally connecting the upper ends of the hangers to a play gym crossbar, said cover including a pair of similar, relatively rigid weather-resistant plates, each plate having an integral orthogonal flange extending around its periphery; means defining an opening near an upper edge of each plate for receiving the play gym crossbar; means defining recesses in the opposing surfaces of said plates for accommodating the pivotal connections between the hangers and the bracket; means for releasably attaching the plates to opposite sides of the glide ride bracket so that the plate extends appreciably beyond the hangers and below the bracket, said attaching means including a first pair of vertically elongated holes in each plate on opposite sides of the opening therein for receiving a pair of threaded fasteners.

2. The cover defined in claim 1 and further including a raised arcuate rib extending around each of said plates adjacent to its periphery.

3. The cover defined in claim 1 wherein said attaching means also include a second pair of holes in each plate on opposite sides of the opening therein for receiving a pair of flexible straps.

4. The cover defined in claim 1 and further including a pair of threaded fasteners for receiving in said first pair of holes.

5. The cover defined in claim 1 and further including a pair of flexible straps for receiving in said second pair of holes.

6. A swing glide ride cover assembly comprising a crossbar; a pair of tubular hangers; a bracket for pivotally connecting the upper ends of hangers to the crossbar; a cover for covering and isolating the pivotal connections between the hangers and the bracket, said cover including a pair of similar relatively rigid, weather-resistant plates, each plate having an opening near an upper edge thereof receiving said crossbar, and means for releasably securing said plates to opposite sides of said bracket, the widths of said plates being such that the side edges thereof extend appreciably beyond said hangers and the heights of said plates being such that the plate lower edges extend appreciably below the pivotal connections of said hangers to said bracket.

7. The cover defined in claim 6 wherein each said plate includes an integral orthogonal flange extending around its periphery.

8. The cover defined in claim 6 and further including means defining recesses in the opposing surfaces of said plates for accommodating the pivotal connections between the hangers and the bracket.

* * * * *